US005910475A

United States Patent [19]

Neumiller et al.

[11] Patent Number: 5,910,475

[45] Date of Patent: Jun. 8, 1999

[54] CLEANING COMPOSITIONS FOR CERAMIC AND PORCELAIN SURFACES AND RELATED METHODS

[75] Inventors: Phillip J. Neumiller; Wayne M. Rees, both of Racine, Wis.

[73] Assignee: S. C. Johnson & Son, Inc., Racine, Wis.

[21] Appl. No.: 09/215,552

[22] Filed: Dec. 18, 1998

Related U.S. Application Data

[62] Division of application No. 08/995,326, Dec. 22, 1997.

[51] Int. Cl.[6] ..... C11D 10/02; C11D 3/20; C11D 3/33

[52] U.S. Cl. ..... 510/238; 510/191; 510/192; 510/477; 510/478; 510/480; 510/490

[58] Field of Search ..... 510/238, 253, 510/269, 274, 446, 477, 478, 490, 480, 117, 191, 192

[56] References Cited

U.S. PATENT DOCUMENTS

| | | | |
|---|---|---|---|
| 3,268,455 | 8/1966 | Bryce et al. | 252/142 |
| 3,620,744 | 11/1971 | Schellenberg et al. | 96/53 |
| 3,931,031 | 1/1976 | Willard, Sr. | 510/418 |
| 3,968,048 | 7/1976 | Bolan | 510/196 |
| 3,973,998 | 8/1976 | Datta et al. | 148/274 |
| 4,200,606 | 4/1980 | Kitko | 422/37 |
| 4,256,599 | 3/1981 | Krisp et al. | 252/99 |
| 4,269,723 | 5/1981 | Barford et al. | 252/106 |
| 4,417,993 | 11/1983 | Gergely | 252/90 |
| 4,470,920 | 9/1984 | Leveskis | 252/142 |
| 4,477,285 | 10/1984 | Ault | 134/3 |
| 4,518,517 | 5/1985 | Eigen et al. | 510/133 |
| 4,552,679 | 11/1985 | Schobel et al. | 252/90 |
| 4,578,207 | 3/1986 | Holdt et al. | 252/134 |
| 4,578,407 | 3/1986 | Amabile et al. | 524/55 |
| 4,670,288 | 6/1987 | Ikari et al. | 427/4 |
| 4,671,972 | 6/1987 | Schobel et al. | 427/213 |
| 4,683,072 | 7/1987 | Holdt et al. | 252/102 |
| 4,806,259 | 2/1989 | Amjad | 252/80 |
| 4,810,413 | 3/1989 | Pancheri et al. | 252/174.12 |
| 4,828,743 | 5/1989 | Rahfield et al. | 252/87 |
| 4,855,069 | 8/1989 | Schuppiser et al. | 252/87 |
| 5,055,305 | 10/1991 | Young | 424/466 |
| 5,078,894 | 1/1992 | Horwitz et al. | 252/81 |
| 5,143,720 | 9/1992 | Lopes | 424/55 |
| 5,192,460 | 3/1993 | Thomas et al. | 252/142 |
| 5,280,042 | 1/1994 | Lopes | 514/557 |
| 5,294,364 | 3/1994 | Thomas et al. | 252/142 |
| 5,306,439 | 4/1994 | Lockhart | 252/174 |
| 5,328,633 | 7/1994 | Hasting et al. | 252/181 |
| 5,431,841 | 7/1995 | Lockhart | 252/90 |
| 5,441,665 | 8/1995 | Massaioli | 252/142 |
| 5,554,320 | 9/1996 | Yianakopoulos | 252/389.23 |
| 5,578,562 | 11/1996 | Lockhart | 510/446 |
| 5,587,142 | 12/1996 | Horwitz et al. | 423/658.5 |
| 5,736,158 | 4/1998 | Quast | 424/464 |
| 5,759,523 | 6/1998 | Hughes et al. | 424/53 |
| 5,827,505 | 10/1998 | Hughes et al. | 424/49 |

FOREIGN PATENT DOCUMENTS

| | | |
|---|---|---|
| 0 055 100 | 6/1982 | European Pat. Off. . |
| 25 20 988 | 11/1975 | Germany . |
| 26 47 364 | 12/1977 | Germany . |

*Primary Examiner*—Ardith Hertzog
*Assistant Examiner*—Christine Ingersoll

[57] ABSTRACT

A cleaning composition for removing kinetically inert high oxidation state metal coordination complex stains, lime scale, soap scum, soil, grease, and biofilm deposits from ceramic surfaces, such as porcelain and glass, and other hard surfaces. The composition includes an acid component; a reducing component; a surfactant system component; and a complexing system component. In one aspect, the cleaning composition includes sulfamic acid, in an amount between about 20 and about 80 weight percent of the composition; isoascorbic acid, in an amount between about 0.1 and about 20 weight percent of the composition, for reducing kinetically inert high oxidation state metal coordination complex stains; a non-interfering surfactant system; and a complexing system comprising ethylenediaminetetraacetic acid and citric acid, the ethylenediaminetetraacetic acid comprising between about 0.01 and about 10 weight percent of the composition, and the citric acid comprising between about 5 and about 45 weight percent of the composition. In another aspect, the invention also relates to methods for cleaning and removing complex stains from surfaces.

7 Claims, No Drawings

CLEANING COMPOSITIONS FOR CERAMIC AND PORCELAIN SURFACES AND RELATED METHODS

This application is a divisional of copending application Ser. No. 08/995,326, filed Dec. 22, 1997.

TECHNICAL FIELD

The present invention relates to cleaning compositions, and in particular, to compositions for use in cleaning ceramics, porcelain, glass, and other hard surfaces. This invention also relates to methods for cleaning and removing complex stains from surfaces.

BACKGROUND ART

Anyone who has ever had to clean a bathroom knows that certain surfaces tend rather quickly and easily to stain, soil, and accumulate mineral deposits and other undesirable build-ups.

In particular, porcelain surfaces, such as toilet bowls and sink basins, have a strong tendency to develop brown, orange, and/or yellow stains. These unsightly-colored stains are caused by metal complexes formed from high oxidation state metal ions, such as iron(III), manganese(III), and manganese(IV), which are typically present in the water supply, or which originate from other sources.

The removal of unsightly-colored stains on ceramic surfaces poses a difficult problem, especially with respect to porcelain toilet bowl cleaning. High oxidation state iron and manganese metals form kinetically inert (as opposed to labile) coordination complexes with the oxide or hydroxide ligand sites on the ceramic surface. Covalent bonding tightly binds the high valence state complexes to the surface. Unlike rust or iron oxide scales, such as FeO, $Fe_2O_3$, and $Fe_3O_4$, found on metal surfaces, these complexes are difficult to remove, even with mechanical abrasive action. Consequently, the complexes persist as the unsightly brown, orange, and/or yellow stains readily visible on the interior of porcelain toilet bowls.

As used hereafter, "kinetically inert metal coordination complex stains" refers to the complexes formed between high valence state metals, including at least iron and manganese, and free oxide or hydroxide ligand sites on surfaces, including at least ceramic and porcelain surfaces. One of ordinary skill in the art will recognize that kinetically inert metal coordination complex stains are distinct and altogether different from rust or iron oxide scales.

Early attempts to solve the above-described problem involved the use of a soluble ferrous salt, such as ferrous chloride, ferrous sulfate or ferrous nitrate, in an acidic cleaning solution comprised of phosphoric acid, hydrochloric acid, and mixtures thereof, as described in U.S. Pat. No. 3,173,875 (the '875 patent). The addition of the ferrous salt was found to increase the effectiveness of the solution in removing iron stains from porcelain surfaces. This patent, however, does not suggest using a reducing agent, such as isoascorbic acid, to remove kinetically inert metal coordination complex stains.

A drawback to the composition of the '875 patent lies in its phosphoric acid component. In recent years, phosphates have been recognized and perceived as being ecologically unsound. In addition, consumer demand for environment-friendly products continues to increase. It is desirable, therefore, to provide a hard surface cleaning composition free from phosphate-based compounds.

U.S. Pat. No. 4,828,743 (the '743 patent) discloses the use of ferrous ions in a non-phosphate cleaning composition for removing rust from toilet bowls, sinks, tubs, tiles, and the like. The ferrous ions were found to enhance the rust removing capability of the composition. To promote storage stability, an oxidation inhibiting substance, such as ascorbic acid or erythorbic acid, may be added to the composition to prevent oxidation of the ferrous ions. This oxidation inhibiting substance, though, does not appear to contribute to the rust removing property of the composition.

Unlike the present invention, however, the cleaning composition in the '743 patent fails to suggest a direct role for a reducing agent, such as isoascorbic acid, in the removal of kinetically inert metal coordination complex stains.

Various other additives have been proposed to improve the ability of acidic compositions to remove undesirable build-ups on hard surfaces. For example, to improve the ability of a composition to remove metal oxides and/or rust, the use of additives is discussed in U.S. Pat. No. 5,078,894, U.S. Pat. No. 5,587,142, and U.S. Pat. No. 4,477,285.

Both U.S. Pat. No. 5,078,894 (the '894 patent) and U.S. Pat. No. 5,587,142 (the '142 patent) disclose the use of a reducing agent in an acidic composition for removing metal oxides, particularly iron oxides, from various hard surfaces. The preferred reducing agent in those patents is sulfur-based. Non-sulfurbased reducing agents, such as ascorbic acid and hydroxylamine hydrochloride, are disclosed as comparative examples, but the data suggests that, relative to the sulfurbased reducing agents, these compounds are ineffective at ambient temperature for removing metal oxides. The preferred acid in those patents is a diphosphonic acid or polyphosphonic acid.

Unlike the present invention, however, the '894 patent and the '142 patent do not address the removal of kinetically inert metal coordination complexes from ceramic surfaces, such as porcelain and glass. Furthermore, the use of a phosphate-based acid in the compositions in those patents raises the same ecological concerns discussed above.

U.S. Pat. No. 4,477,285 (the '285 patent) discloses a two component composition for treating a surface susceptible to oxidation, such as wood, plastic, ceramic, or metal. The composition consists of a particulate abrasive material and an ascorbic-type reducing compound. The abrasive material removes paint, surface finishes, rust, or other oxidized layers coated on or integral with the surface, when the composition is rubbed thereon. The reducing compound then functions primarily as a protective agent to accept or intercept oxidizers which would otherwise contact the abraded surface.

Although recognized as providing some rust removing-function due to their acidity, the ascorbic-type reducing compounds in the '285 patent function primarily as antioxidants, and not as reducing agents, to protect cleaned surfaces from oxidative degradation. Moreover, that patent fails to suggest an active role for a reducing agent, such as isoascorbic acid, in the removal of oxidized layers from hard surfaces.

The state of the art in bathroom cleaning solutions today utilizes strong acids, such as hydrochloric, sulfuric, phosphoric, and the like, in combination with a small quantity of surfactant, dye, and fragrance. Some of the products on the market utilize combinations of acids which improve performance. These aqueous acid solutions lower tap water pH down between about pH 1.0 and about pH 3.0, but as demonstrated below in the Comparative Tests, they only exhibit a fair effect, if any, in removing kinetically inert metal coordination complex stains, lime scale, and soap scum. Unlike the present invention, these bathroom cleaning solutions do not include a reducing agent component, such as isoascorbic acid, to accelerate stain removal. Furthermore, strong mineral acids, such as hydrochloric acid and sulfuric acid, can damage (e.g., cause erosion and/or pitting of) the porcelain surface, thereby causing the porcelain surface to soil more quickly.

A cleaning composition for ceramics, porcelain, glass, and other hard surfaces should remove at least lime scale, soap scum, soil, grease, and biofilm deposited thereon, in addition to removing kinetically inert metal coordination complex stains. Various acid-based compositions have been proposed to remove lime scale, soap scum, and grease from hard surface items, including bathroom surfaces, as disclosed in U.S. Pat. No. 5,192,460, U.S. Pat. No. 5,294,364, and U.S. Pat. No. 5,554,320. However, none of the compositions disclosed therein suggests any effectiveness in removing kinetically inert metal coordination complex stains from ceramics and other hard surfaces. Furthermore, none of these patents discloses or suggests the use of an additive, such as a reducing agent, to improve the stain removing ability of the composition.

The above discussion illustrates the need for a cleaning composition effective in removing kinetically inert metal coordination complex stains, lime scale, soap scum, soil, grease, biofilm, and other build-ups from ceramic, porcelain, glass, and other hard surfaces. Heretofore, no composition has been capable of achieving such cleaning functions.

DISCLOSURE OF INVENTION

An object of the present invention is to provide a cleaning composition for removing at least kinetically inert metal coordination complex stains, lime scale, soap scum, soil, grease, biofilm, and other build-ups from ceramic, porcelain, glass, and other hard surfaces.

Minimal or no mechanical-abrasive action is required, when using a cleaning composition of the present invention to remove stains and deposits from surfaces. Our unique chemical composition not only employs acid and surfactants, but more importantly, also employs reducing and complexing agents to accelerate the removal. This chemical combination rinses away clean with little stain/soil-redeposition. In some cases, contacting a stain with the composition in an aqueous medium alone will clean completely a porcelain surface, in a matter of seconds. This result is unexpected and satisfies a long felt need, because heretofore, complete stain removal could not occur without aggressive mechanical abrasion.

In one aspect of our invention, there is provided a cleaning composition for removing at least kinetically inert metal coordination complex stains from a surface, the composition comprising, in combination, sulfamic acid, in an amount between about 20 and about 80 weight percent of the composition; isoascorbic acid, in an amount between about 0.1 and about 20 weight percent of the composition, for reducing the kinetically inert metal coordination complex stains; a surfactant system comprising sodium lauryl sulfate and sodium dioctyl sulfosuccinate, the sodium lauryl sulfate comprising between about 1 and about 20 weight percent of the composition, and the sodium dioctyl sulfosuccinate comprising between about 1 and about 30 weight percent of the composition; and a complexing system comprising ethylenediaminetetraacetic acid and citric acid, the ethylenediaminetetraacetic acid comprising between about 0.01 and about 10 weight percent of the composition, and the citric acid comprising between about 5 and about 45 weight percent of the composition.

In another aspect of this invention, a cleaning composition for removing at least kinetically inert metal coordination complex stains from a surface comprises, in combination, sulfamic acid, in an amount between about 20 and about 80 weight percent of the composition; oxalic acid, in an amount between about 0.1 and about 20 weight percent of the composition, for reducing the kinetically inert metal coordination complex stains; a non-interfering surfactant system; and a complexing system comprising ethylenediaminetetraacetic acid and citric acid, the ethylenediaminetetraacetic acid comprising between about 0.01 and about 10 weight percent of the composition, and the citric acid comprising between about 5 and about 45 weight percent of the composition.

In still another aspect, there is provided a cleaning composition for removing at least kinetically inert metal coordination complex stains from a surface, the composition comprising, in combination, sodium bisulfate, in an amount between about 10 and about 80 weight percent of the composition; isoascorbic acid, in an amount between about 0.1 and about 20 weight percent of the composition, for reducing the kinetically inert metal coordination complex stains; a non-interfering surfactant system; and a complexing system comprising ethylenediaminetetraacetic acid and citric acid, the ethylenediaminetetraacetic acid comprising between about 0.01 and about 10 weight percent of the composition, and the citric acid comprising between about 5 and about 45 weight percent of the composition.

In still another aspect of our invention, a cleaning composition for removing at least kinetically inert metal coordination complex stains from a surface comprises, in combination, sulfamic acid, in an amount between about 20 and about 80 weight percent of the composition; hydroxylamine salt, in an amount between about 1 and about 10 weight percent of the composition, for reducing the kinetically inert metal coordination complex stains; a non-interfering surfactant system; and a complexing system comprising ethylenediaminetetraacetic acid and citric acid, the ethylenediaminetetraacetic acid comprising between about 0.01 and about 10 weight percent of the composition, and the citric acid comprising between about 5 and about 45 weight percent of the composition.

Another object of the present invention is to provide single-layered, two-layered, or multi-layered cleaning tablets having the composition of our invention, for use in an aqueous medium and for removing at least kinetically inert metal coordination complex stains, lime scale, soap scum, soil, grease, biofilm, and other build-ups from ceramic, porcelain, glass, and other hard surfaces.

Still another object of the present invention is to provide single, two-part, or multi-part powder formulations and granular formulations having the composition of our invention, for use in an aqueous medium and for removing at least kinetically inert metal coordination complex stains, lime scale, soap scum, soil, grease, biofilm, and other build-ups from ceramic, porcelain, glass, and other hard surfaces.

Yet another object of the present invention is to provide a method for cleaning and removing at least kinetically inert metal coordination complex stains, lime scale, soap scum, soil, grease, biofilm, and other build-ups from ceramic, porcelain, glass, and other hard surfaces.

In one aspect, a method for cleaning and removing at least kinetically inert metal coordination complex stains from a surface comprises applying to the surface a composition comprising isoascorbic acid, in an amount between about 0.1 and about 20 weight percent of the composition, for reducing the kinetically inert metal coordination complex stains; sulfamic acid, in an amount between about 20 and about 80 weight percent of the composition; a non-interfering surfactant system; and a complexing system comprising ethylenediarninetetraacetic acid and citric acid, the ethylenediaminetetraacetic acid comprising between about 0.01 and about 10 weight percent of the composition, and the citric acid comprising between about 5 and about 45 weight percent of the composition. The composition is dissolved in a solvent such as water prior to or after its application to the surface in order to activate the composition.

Other aspects of this invention will be better understood and advantages thereof more apparent in view of the following detailed description of the preferred embodiments.

MODES OF CARRYING OUT THE INVENTION

Main components of the cleaning composition of our invention include, in combination:

(i) an acid component;

(ii) a reducing component;

(iii) a surfactant system component; and (iv) a complexing system component.

In addition to these four components, our cleaning composition, in another aspect, can include an effervescing component.

The cleaning composition of this invention can also include, as optional components, various common additives, such as catalysts, adsorbents, fragrances, dyes, and/or colorants.

Each of the components is discussed in greater detail, as follows.

Acid Component

The acid component preferably comprises a dry powder acid The acid component preferably comprises a single acid, but may also comprise a plurality of acids in combination. When a plurality of acids are used in combination, the acid component comprises preferably between about 10 and about 80 weight percent of the composition, more preferably between about 20 and about 75 weight percent of the composition, and most preferably between about 40 and about 70 weight percent of the composition.

Sulfamic acid is the most preferred acid. Sodium bisulfate, oxalic acid, and Lcystine dihydrogen chloride are preferred acids.

Sulfamic acid comprises preferably between about 20 and about 80 weight percent of the composition, more preferably between about 30 and about 60 weight percent of the composition, and most preferably between about 40 and about 55 weight percent of the composition.

Sodium bisulfate comprises preferably between about 10 and about 80 weight percent of the composition, more preferably between about 10 and about 60 weight percent of the composition, and most preferably between about 40 and about 60 weight percent of the composition.

Oxalic acid comprises preferably between about 0.1 and about 20 weight percent of the composition, more preferably between about 2 and about 8 weight percent of the composition, and most preferably between about 4 and about 6 weight percent of the composition.

L-cystine dihydrogen chloride comprises preferably between about 1 and about 10 weight percent of the composition, more preferably between about 2 and about 8 weight percent of the composition, and most preferably between about 2 and about 4 weight percent of the composition.

Reducing Component

The reducing component preferably comprises a reducing agent that is effective in reducing kinetically inert metal coordination complex stains. The reducing component preferably comprises a single reducing agent, but may also comprise a plurality of reducing agents in combination. When a plurality of reducing agents are used, the reducing component comprises preferably between about 0.1 and about 20 weight percent of the composition, more preferably between about 1 and about 12 weight percent of the composition, and most preferably between about 3 and about 9 weight percent of the composition. Anhydrous forms of the reducing agents are highly preferred.

The reducing component most preferably comprises isoascorbic acid, otherwise known as d-isoascorbic acid, d-araboascorbic acid or erythorbic acid. One of ordinary skill will appreciate that d-isoascorbic acid, d-araboascorbic acid, and erythorbic acid are recognized as equivalent chemical names for isoascorbic acid. Thus, hereinafter the term "isoascorbic acid" is used, unless indicated otherwise. Alkali metal salts of isoascorbic acid may also be used.

Other preferred reducing agents include oxalic acid; a hydroxylamine salt, such as hydroxylamine hydrochloride, hydroxylamine nitrate, hydroxylamine phosphate, or hydroxylamine sulfate; potassium iodide; and sodium iodide. Alkali metal salts of oxalic acid may also be used.

We have found that the use of isoascorbic acid, oxalic acid, or a hydroxylamine salt as a reducing agent leads to superior results in the removal of kinetically inert metal coordination complex stains. As demonstrated below in the Comparative Tests, this invention significantly outperforms the closest leading commercial brands of cleaning compositions in effecting removal of kinetically inert metal coordination complex stains, lime scale, and soap scum.

Isoascorbic acid comprises preferably between about 0.1 and about 20 weight percent of the composition, more preferably between about 0.5 and about 10 weight percent of the composition, and most preferably between about 1 and about 5 weight percent of the composition. These same ranges apply to alkali metal salts of isoascorbic acid.

Oxalic acid comprises preferably between about 0.1 and about 20 weight percent of the composition, more preferably between about 2 and about 8 weight percent of the composition, and most preferably between about 4 and about 6 weight percent of the composition. These same ranges also apply to alkali metal salts of oxalic acid.

A hydroxylamine salt comprises preferably between about 0.1 and about 10 weight percent of the composition, most preferably between about 1 and about 8 weight percent of the composition, and most preferably between about 2 and about 4 weight percent of the composition.

Each of potassium iodide and sodium iodide comprises preferably between about 0.05 and about 7.5 weight percent of the composition, more preferably between about 0.05 and about 5 weight percent of the composition, and most preferably between about 0.2 and about 2 weight percent of the composition.

Surfactant System Component

The surfactant system component is non-interfering, i.e, it does not negatively affect the performance of compositions of the present invention. Preferably the sufactant component comprises a dry powder surfactant system. The surfactant system component preferably comprises at least two different surfactants, but may also comprise a single surfactant. The surfactant system component comprises preferably between about 1 and about 50 weight percent of the composition, more preferably between about 1 and about 20 weight percent of the composition, and most preferably between about 5 and about 10 weight percent of the composition.

A preferred two-surfactant system comprises sodium lauryl sulfate and sodium dioctyl sulfosuccinate. Sodium lauryl sulfate, is preferred, because of its high foaming properties. Sodium dioctyl sulfosuccinate is preferred, because it is a multi-functional complexing surfactant.

Sodium lauryl sulfate comprises preferably between about 1 and about 20 weight percent of the composition, more preferably between about 1 and about 15 weight percent of the composition, and most preferably between about 2 and about 4 weight percent of the composition. Sodium dioctyl sulfosuccinate comprises preferably between about 1 and about 30 weight percent of the composition, more preferably between about 1 and about 10 weight percent of the composition, and most preferably between about 1 and about 6 weight percent of the composition.

A preferred one-surfactant system comprises lauryl amido propyl betaine. Lauryl amido propyl betaine comprises preferably between about 1 and about 40 weight percent of the composition, more preferably between about 2 and about 30 weight percent of the composition, and most preferably between about 4 and about 8 weight percent of the composition.

Other preferred surfactant components include lauramide monoethanol amine, sodium alpha olefin sulfonate, sodium lauryl sulfoacetate, sodium dodecylbenzene sulfonate, glycol monostearate, glyceryl stearate, dicyclohexyl sodium sulfosuccinate, and sodium isopropyl naphthalene sulfonate.

Each of lauramide monoethanol amine, sodium alpha olefin sulfonate, sodium lauryl sulfoacetate, sodium dodecylbenzene sulfonate, glycol mQnostearate, and glyceryl stearate comprises preferably between about 1 and about 10 weight percent of the composition, more preferably between about 1 and about 8 weight percent of the composition, and most preferably between about 2 and about 4 weight percent of the composition.

Each of dicyclohexyl sodium sulfosuccinate and sodium isopropyl naphthalene sulfonate comprises preferably between about 1 and about 10 weight percent of the composition, more preferably between about 1 and about 8 weight percent of the composition, and most preferably between about 3 and about 5 weight percent of the composition.

Complexing System Component

The complexing system component preferably comprises at least two different complexing agents, but may also comprise a single complexing agent. Anhydrous forms of the complexing agents are highly preferred.

The complexing system component comprises preferably between about 5 and about 55 weight percent of the composition, more preferably between about 5 and about 35 weight percent of the composition, and most preferably between about 10 and about 25 weight percent of the composition.

A preferred complexing system comprises the following two complexing agents, in combination: ethylenediaminetetraacetic acid (EDTA), as a chelating agent, and citric acid-Alkali metal salts of EDTA may also be used (e.g., tetrasodium EDTA). EDTA comprises preferably between about 0.01 and about 10 weight percent of the composition, more preferably between about 0.01 and about 7.5 weight percent of the composition, and most preferably between about 1 and about 3 weight percent of the composition. These same ranges also apply for alkali metal salts of EDTA.

Citric acid comprises preferably between about 5 and about 45 weight percent of the composition, more preferably between about 5 and about 30 weight percent of the composition, and most preferably between about 10 and about 25 weight percent of the composition.

Other preferred complexing agent components include α-glucoheptonic-g-lactone, sodium glucoheptanoate, potassium glucoheptanoate, imino diacetic acid, imino diacetic acid salts, δ-glucono-lactone, sodium gluconate, potassium gluconate, and multi-functional acids, such as glutaric, succinic, and adipic acids.

Each of α-glucoheptonic-g-lactone, sodium glucoheptanoate, potassium glucoheptanoate, imino diacetic acid, imino diacetic acid salts, δ-glucono-lactone, sodium gluconate, and potassium gluconate comprises preferably between about 0.1 and about 10 weight percent of the composition, more preferably between about 0.1 and about 8 weight percent of the composition, and most preferably between about 1 and about 3 weight percent of the composition.

Each of glutaric, succinic, and adipic acids comprises preferably between about 1 and about 45 weight percent of the composition, more preferably between about 1 and about 30 weight percent of the composition, and most preferably between about 5 and about 20 weight percent of the composition.

Effervescing Component

The effervescing component preferably comprises a single effervescing agent, but may also comprise a plurality of effervescing agents in combination.

When a plurality of effervescing agents are used, the effervescing component comprises preferably between about 1 and about 50 weight percent of the composition, more preferably between about 5 and about 50 weight percent of the composition, and most preferably between about 10 and about 30 weight percent of the composition.

Preferred effervescing agents include alkali metal, alkaline earth, and ammonium bicarbonate and carbonate compounds. A most preferred effervescing agent is an alkali metal bicarbonate, because alkali metal bicarbonates readily react with an acid to produce $CO_2$ gas. Potassium bicarbonate is most preferred, and sodium bicarbonate is also preferred, because each produces an abundant supply of $CO_2$ gas. Each can be used alone or in combination with the other.

Potassium bicarbonate comprises preferably between about 1 and about 50 weight percent of the composition, more preferably between about 5 and about 40 weight percent of the composition, and most preferably between about 10 and about 20 weight percent of the composition.

Sodium bicarbonate comprises preferably between about 1 and about 50 weight percent of the composition, more preferably between about 1 and about 25 weight percent of the composition, and most preferably between about 5 and about 15 weight percent of the composition.

Optional Additive Components

Additive components to the cleaning composition are optional components. When used in the cleaning composition, additive components comprise those typically used in the field, including, but not limited to, catalysts, adsorbents, fragrances, colorants, and/or dyes. Each additive component may be used alone or in combination with any of the other additive components, optionally, in the cleaning composition.

Catalysts include potassium chloride and sodium chloride. Potassium chloride and sodium chloride rapidly dissolve in an aqueous medium, and the rapid rate of tablet (solid) dissolution promotes the rate of generation of the $CO_2$ system by the effervescing component. Thus, potassium bicarbonate and sodium bicarbonate, employed above as effervescing components, also contribute to promotion of the reaction rate, because these compounds rapidly dissolve in water.

Each of potassium chloride and sodium chloride, when used in the composition, may comprise preferably up to about 7.5 weight percent of the composition, more preferably between about 0.05 and about 5 weight percent of the composition, and most preferably between about 0.2 and about 2 weight percent of the composition.

Adsorbents, when used in the composition, may comprise preferably up to about 10 weight percent of the composition, more preferably between about 0.01 and about 3 weight percent of the composition, and most preferably between about 0.5 and about 2 weight percent of the composition. Preferred adsorbents include colloidal silica gels, alumina gels, and $Na_2SO_4$.

Fragrances, when used in the composition, may comprise preferably up to about 10 weight percent of the composition, more preferably between about 0.01 and about 3 weight percent of the composition, and most preferably between about 0.1 and about 0.3 weight percent of the composition. Any fragrances, including those commercially available, may be employed.

Dyes and colorants, when used in the composition, may comprise preferably up to about 2 weight percent of the composition, more preferably up to about 1 weight percent of the composition, and most preferably between about 0.01 and about 0.1 weight percent of the composition. Any dyes and colorants, including those commercially available, may be employed.

The cleaning composition of our invention is preferably embodied in a solid tablet formulation, and most preferably in a two-layered solid tablet formulation, although a single layer tablet and a multi-layered tablet (i.e., a tablet having more than two layers) are also preferred formulations. Other preferred formulations include powder and granular formulations. Each of the powder and granular formulations may be embodied in two-part formulations or multi-part (i.e., more than two parts) formulations.

If embodied in a tablet, powder, or granular formulation having two or more layers or parts, a cleaning composition of our invention may be distributed in each layer or part in any combination of components and/or amounts. In addition, our invention is not limited to tablet, powder, and granular formulations produced according to a specific manufacturing process. One of ordinary skill will readily recognize that various compression machines, mixing devices, techniques, and methods may be employed to produce the tablet, powder, and granular formulations of the present invention.

Our invention also includes a method for removing at least kinetically inert metal coordination complex stains, soap scum, lime scale, soil, grease, biofilm and/or other buildups from a surface. In one aspect, a method comprises treating such a surface with a composition of our invention, wherein the reducing component (e.g., isoascorbic acid, oxalic acid, or hydroxylamine salt) of the composition at least reduces the kinetically inert metal coordination complex stains.

Our compositions are preferably used at ambient temperature and do not require elevated temperatures to effect cleaning. The compositions have been found to be effective at least in the temperature range between about 1° C. and about 25° C.

EXAMPLES

The following examples set forth below in Tables 1 through 6, namely Examples 1 through 18, illustrate embodiments of our invention. Examples 1 through 9 encompass tablet, powder, or granular formulations. Examples 10 through 18 embody either two-layered tablet formulations, two-part powder formulations, or two-part granular formulations. All amounts are given in weight percent. The present invention is not limited to these examples.

TABLE 1

| Material | EXAMPLE 1 | EXAMPLE 2 | EXAMPLE 3 |
|---|---|---|---|
| Sulfamic Acid | 47.755 | 46 | 45.72 |
| Potassium Bicarbonate | 17.955 | 20.58 | 17.5 |
| Sodium Bicarbonate | 5.12 | | 5.01 |
| Isoascorbic Acid | 3 | | 3 |
| Oxalic Acid | | 5 | |
| Sodium Lauryl Sulfate | 3 | 3 | |
| Sodium Dioctyl Sulfosuccinate | 4 | 4 | |
| Lauryl Amido Propyl Betaine | | | 7 |
| EDTA | 2.15 | 2.15 | 2 |
| Citric Acid | 14.75 | 18 | 17.5 |
| Potassium Chloride | 1 | | 1 |
| Colloidal Silica Gel | 1 | 1 | 1 |
| Colorants/Dyes | 0.07 | 0.07 | 0.07 |
| Fragrance | 0.2 | 0.2 | 0.2 |
| TOTAL | 100 | 100 | 100 |

TABLE 2

| Material | EXAMPLE 4 | EXAMPLE 5 | EXAMPLE 6 |
|---|---|---|---|
| Sulfamic Acid | 45.5 | 46.5 | 48.5 |
| Potassium Bicarbonate | 18.83 | 20.58 | 20.58 |
| Sodium Bicarbonate | 8.25 | | |
| Isoascorbic Acid | 3 | | 3 |
| Oxalic Acid | | 5 | |
| Sodium Lauryl Sulfate | 3 | 3 | 3 |
| Sodium Dioctyl Sulfosuccinate | 4 | 4 | 4 |
| EDTA | 2.15 | 2.15 | 2.15 |
| Citric Acid | 11 | 18.5 | 18.5 |
| Potassium Chloride | 1 | | |
| Colorants/Dyes | 0.07 | 0.07 | 0.07 |
| Fragrance | 0.2 | 0.2 | 0.2 |
| TOTAL | 100 | 100 | 100 |

TABLE 3

| Material | EXAMPLE 7 | EXAMPLE 8 | EXAMPLE 9 |
|---|---|---|---|
| Sulfamic Acid | 48.5 | | 47.75 |
| Sodium bisulfate | | 44.12 | |

TABLE 3-continued

| Material | EXAMPLE 7 | EXAMPLE 8 | EXAMPLE 9 |
|---|---|---|---|
| Potassium Bicarbonate | 20.58 | 19.11 | 17.955 |
| Sodium Bicarbonate | | | 5.125 |
| Isoascorbic Acid | | 3 | 3 |
| Hydroxylamine Hydrochloride | 3 | | |
| Sodium Lauryl Sulfate | 3 | 3 | |
| Sodium Lauryl Sulfoacetate | | | 5 |
| Sodium Dioctyl Sulfosuccinate | 4 | 4 | 2 |
| EDTA | 2.15 | 2 | 2.15 |
| Citric Acid | 18.5 | 22.5 | 14.75 |
| Potassium Chloride | | 1 | 1 |
| Colloidal Silica Gel | | 1 | 1 |
| Colorants/Dyes | 0.07 | 0.07 | 0.07 |
| Fragrance | 0.2 | 0.2 | 0.2 |
| TOTAL | 100 | 100 | 100 |

TABLE 4

| | EXAMPLE 10 | | EXAMPLE 11 | | EXAMPLE 12 | |
|---|---|---|---|---|---|---|
| Material | 1 | 2 | 1 | 2 | 1 | 2 |
| Sulfamic Acid | 52.5 | 43 | 53.5 | 38.5 | 52.5 | 38.94 |
| Potassium Bicarbonate | 15.47 | 20.44 | 18.22 | 22.94 | 15 | 20 |
| Sodium Bicarbonate | 10.25 | | | | 10.02 | |
| Isoascorbic Acid | | 6 | | | | 6 |
| Oxalic Acid | | | | 10 | | |
| Sodium Lauryl Sulfate | | 6 | | 6 | | |
| Sodium Dioctyl Sulfosuccinate | 5 | 3 | 5 | 3 | | |
| Lauryl Amido Propyl Betaine | | | | | 7 | 7 |
| EDTA | 4.3 | | 4.3 | | 4 | |
| Citric Acid | 11 | 18.5 | 17.5 | 18.5 | 10 | 25 |
| Potassium Chloride | | 2 | | | | 2 |
| Colloidal Silica Gel | 1 | 1 | 1 | 1 | 1 | 1 |
| Colorants/Dyes | 0.08 | 0.06 | 0.08 | 0.06 | 0.08 | 0.06 |
| Fragrance | 0.4 | | 0.4 | | 0.4 | |
| TOTAL | 100 | 100 | 100 | 100 | 100 | 100 |

TABLE 5

| | EXAMPLE 13 | | EXAMPLE 14 | | EXAMPLE 15 | |
|---|---|---|---|---|---|---|
| Material | 1 | 2 | 1 | 2 | 1 | 2 |
| Sulfamic Acid | 53.5 | 43.5 | 53.5 | 39.5 | 53.5 | 43.5 |
| Potassium Bicarbonate | 15.47 | 22.19 | 18.22 | 22.94 | 18.22 | 22.94 |
| Sodium Bicarbonate | 10.25 | 6.25 | | | | |
| Isoascorbic Acid | | 6 | | | | 6 |
| Oxalic Acid | | | | 10 | | |
| Sodium Lauryl Sulfate | | 6 | | 6 | | 6 |
| Sodium Dioctyl Sulfosuccinate | 5 | 3 | 5 | 3 | 5 | 3 |
| EDTA | 4.3 | | 4.3 | | 4.3 | |
| Citric Acid | 11 | 11 | 18.5 | 18.5 | 18.5 | 18.5 |
| Potassium Chloride | | 2 | | | | |

TABLE 5-continued

| | EXAMPLE 13 | | EXAMPLE 14 | | EXAMPLE 15 | |
|---|---|---|---|---|---|---|
| Material | 1 | 2 | 1 | 2 | 1 | 2 |
| Colloidal Silica Gel | | | | | | |
| Colorants/Dyes | 0.08 | 0.06 | 0.08 | 0.06 | 0.08 | 0.06 |
| Fragrance | 0.4 | | 0.4 | | 0.4 | |
| TOTAL | 100 | 100 | 100 | 100 | 100 | 100 |

TABLE 6

| | EXAMPLE 16 | | EXAMPLE 17 | | EXAMPLE 18 | |
|---|---|---|---|---|---|---|
| Material | 1 | 2 | 1 | 2 | 1 | 2 |
| Sulfamic Acid | 53.5 | 43.5 | | | 52.5 | 43 |
| Sodium bisulfate | | | 51.3 | 36.94 | | |
| Potassium Bicarbonate | 18.22 | 22.94 | 18.22 | 20 | 15.47 | 20.44 |
| Sodium Bicarbonate | | | | | 10.25 | |
| Isoascorbic Acid | | | | 6 | | 6 |
| Oxalic Acid | | | | | | |
| Hydroxylamine Hydrochloride | | 6 | | | | |
| Sodium Lauryl Sulfate | | 6 | | 6 | | |
| Sodium Lauryl Sulfoacetate | | | | | 5 | 5 |
| Sodium Dioctyl Sulfosuccinate | 5 | 3 | 5 | 3 | | 4 |
| EDTA | 4.3 | | 4 | | 4.3 | |
| Citric Acid | 18.5 | 18.5 | 20 | 25 | 11 | 18.5 |
| Potassium Chloride | | | | 2 | | 2 |
| Colloidal Silica Gel | | | 1 | 1 | 1 | 1 |
| Colorants/Dyes | 0.08 | 0.06 | 0.08 | 0.06 | 0.08 | 0.06 |
| Fragrance | 0.4 | | 0.4 | | 0.4 | |
| TOTAL | 100 | 100 | 100 | 100 | 100 | 100 |

COMPARATIVE TESTING

The cleaning composition of this invention produces exceptional results in comparison to currently available toilet bowl cleaning formulations on the market, as demonstrated below in Comparative Tests 1, 2, and 3.

Although the cleaning composition of this invention is well-suited to toilet bowl cleaning, one of ordinary skill will recognize that the composition can be used to clean any ceramic or hard surface that is susceptible to formation of kinetically inert high oxidation state metal coordination complex stains. Further, the cleaning composition of this invention may also be used to clean "soft" resilient surfaces, such as textiles, rubber, plastics, and the like. The comparative tests discussed herein are merely illustrative of the broad stain-removing and cleaning ability of this invention, and are not meant-to limit the application of the invention to cleaning of bathroom surfaces.

Comparative Test 1

Cleaning compositions of the present invention were tested for their ability to remove kinetically inert iron and manganese metal coordination complex stains from sample ceramic tiles and toilets. As used hereafter in all of the Comparative Tests, "iron stain," "manganese stain," and "toilet stain" refer to kinetically inert metal coordination complex stains.

Employed were cleaning tablets having the compositions listed above in Examples 13, 14, and 17 (hereafter referred to as "Sample 1.1", "Sample 1.2," and "Sample 1.3," respectively). For comparative purposes, we also tested two leading toilet bowl cleaning formulations currently available in the market place (hereafter referred to as "Comparative Sample 1.1" and "Comparative Sample 1.2").

The cleaning tablets and cleaning solutions were prepared as dilute solutions for testing purposes, by dissolving each of the cleaning tablets (or by mixing 118.28 ml (4 ounces) of each of the toilet bowl cleaning formulations) in 2000 mL of tap water.

Iron-stained tiles were prepared by evaporating a partially neutralized ferric chloride solution onto lightly-etched glazed ceramic tiles at ambient room temperature and letting the tiles age. The use of lightly-etched glazed ceramic tiles results in tenacious stains that will not rinse off with water and are resistant to all but the harshest abrasion.

Manganese-stained tiles were created by covering a lightly-etched glazed ceramic tile with a Mn(II) solution, then spraying it with a dilute household bleach solution.

Stained toilets were obtained by subjecting various commercial brands of toilets to a toilet lab flush test of ten (10) flushes per day with water from a city water supply containing iron and manganese. We used commercial brand toilets manufactured by Kohler, Mansfield, and American Standard.

To test iron stain removal, a drop of each cleaning sample was placed alone on an individual iron-stained tile and allowed to react without any mechanical abrasion being applied. After standing for 3 minutes, the tiles were rinsed with deionized water.

To test manganese stain removal, a drop of each cleaning sample was placed alone on an individual manganese-stained tile and allowed to react without any mechanical abrasion being applied for at least 3 minutes. The tiles were then rinsed with deionized water.

To test removal of iron and manganese stains from sample stained toilets, ten (10) microliters of each cleaning sample were extracted, and each solution was placed alone on an individual stained toilet. After standing for 3 minutes, the toilets were rinsed with deionized water.

The areas of the tiles and toilets covered by the cleaning samples were then evaluated on a scale of 1 to 10, where a rating of 10 equals 100 percent stain removal, 9 approximately 90 percent stain removal, 8 approximately 80 percent stain removal, and so forth. The results are set forth below in Table 7. The manganese reduction reaction time represents the actual time it took each sample or comparative sample to achieve the indicated manganese stain removal rating.

TABLE 7

| Cleaning Sample | Mn Reduction Reaction Time | Cleaning Rating (1–10) Mn Stain | Fe Stain | Toilet Stain |
|---|---|---|---|---|
| Sample 1.1 (isoascorbic acid) | 30 seconds | 10 | 8 | 10 |
| Sample 1.2 (oxalic acid) | 20 seconds | 10 | 8 | 10 |

TABLE 7-continued

| Cleaning Sample | Mn Reduction Reaction Time | Cleaning Rating (1–10) Mn Stain | Fe Stain | Toilet Stain |
|---|---|---|---|---|
| Sample 1.3 (isoascorbic acid, sodium bisulfate) | 15 seconds | 10 | 9 | 10 |
| Comparative Sample 1.1 | 3 minutes | 1 | 9 | 2 |
| Comparative Sample 1.2 | 3+ minutes | 5 | 5 | 1 |

As the above results demonstrate, the formulations of the present invention significantly outperformed the currently available cleaning products, with respect to manganese and iron stain removal from sample ceramic tiles and toilets.

Comparative Test 2

Cleaning compositions of this invention were tested for their ability to remove iron and manganese stains from sample ceramic tiles and toilets. Employed were a cleaning tablet having the composition of Example 10 (hereafter referred to as "Sample 2.1") and a cleaning tablet having the composition of Example 11 (hereafter referred to as "Sample 2.2").

For comparative purposes, we also tested a cleaning tablet having the composition of Example 10 minus the isoascorbic acid reducing agent component (hereafter referred to as "Comparative Sample 2.1"); a cleaning tablet having the composition of Example 11 minus the oxalic acid reducing agent component (hereafter referred to as "Comparative Sample 2.2"); and a leading toilet bowl cleaning formulation currently available in the market place (hereafter referred to as "Comparative Sample 2.3").

The cleaning tablets and cleaning solutions were prepared as dilute solutions for testing purposes, by dissolving each of the cleaning tablets (or by mixing 118.28 ml (4 ounces) of the toilet bowl cleaning formulation) in 2000 mL of tap water.

Manganese-stained tiles, iron-stained tiles, and stained toilets were prepared in accordance with the same methods outlined above in Comparative Test 1. The same experimental and evaluative procedures in Comparative Test 1 were also followed. The results are displayed below in Table 8.

TABLE 8

| Cleaning Sample | Iron Stain | Mn Stain | Toilet Stain | Average |
|---|---|---|---|---|
| Sample 2.1 | 3 | 10 | 10 | 7.6 |
| Sample 2.2 | 2 | 10 | 10 | 7.3 |
| Comparative Sample 2.1 | 1.3 | 8 | 5 | 4.76 |
| Comparative Sample 2.2 | 1.3 | 9 | 5 | 5.1 |
| Comparative Sample 2.3 | 1.6 | 6.3 | 5 | 4.3 |

Without a reducing agent (isoascorbic acid or oxalic acid), diminished iron and manganese stain removal occurs, as the above results from Comparative Sample 2.1 and Comparative Sample 2.2 demonstrate.

Comparative Test 3

Cleaning compositions of the present invention were tested for their ability to remove iron stains, manganese stains, and soap scum from sample ceramic tiles, and for their ability to remove lime scale from sample swatches. The compositions employed were cleaning tablets (hereafter referred to as "DAT 1," "DAT 2," and "DAT 3") each having the composition listed above in Example 15 (isoascorbic acid as the reducing agent component).

In addition, we tested cleaning tablet embodiments of the present invention employing different reducing agent components, as indicated below in Table 9 (hereafter referred to as "Sample 3.1," "Sample 3.2," and "Sample 3.3"). Sample 3.3 employs isoascorbic acid sold under the name Erythorbic Acid or D-Erythroascorbic Acid, manufactured by Van Waters-Rogers.

For comparative purposes, we also tested three leading toilet bowl cleaning formulations currently available in the market place (hereafter referred to as "Comparative Sample 3.1," "Comparative Sample 3.2," and "Comparative Sample 3.3," respectively).

The cleaning tablets and cleaning solutions were prepared as dilute solutions for testing purposes, by dissolving each of the cleaning tablets (or by mixing 4 ounces (approx. 118.28 ml) of each of the toilet bowl cleaning formulations) in 2000 mL of tap water.

Manganese-stained tiles and iron-stained tiles were prepared in accordance with the same procedure outlined above in Comparative Test 1.

Sample tiles containing layers of soap scum were prepared by spraying a soap scum solution evenly onto Formical® tiles measuring 5"×8" (12.7 cm×20.3 cm), and allowing the tiles to dry for at least 30 minutes under a fume hood. The tiles were checked visually for consistency.

Sample swatches containing layers of lime scale were prepared from dirty, used shower curtains obtained from household bathrooms. We used shower curtains, because they provide a good source of lime scale. The shower curtains were cut into 6" (15.24 cm) square swatches and tacked onto a wooden block.

To test manganese stain removal, ten (10) microliters of each cleaning sample were extracted, and each solution was placed alone on an individual manganese-stained tile. After standing for 3 minutes, the tiles were rinsed with deionized water and dried lightly with a paper towel.

To test iron stain removal, ten (10) microliters of each cleaning sample were extracted, and each solution was placed alone on an individual iron-stained tile. After standing for 3 minutes, the tiles were rinsed with deionized water.

To test soap scum removal, ten (10) microliters of each cleaning sample were extracted, and each solution was placed alone on an individual soap scum tile. After standing for 20 minutes, the tiles were rinsed with deionized water and dried lightly with a paper towel.

To test lime scale removal, individual Q-TIP (trademark) swabs were dipped in each of the cleaning samples, and each swab was wiped back and forth three times on an individual lime scale swatch.

The same evaluation procedure used in Comparative Test 1 was then used to evaluate the cleaning and stain removing ability of each cleaning sample. The results are displayed below in Table 9.

TABLE 9

| Cleaning Sample | Variable | Mn Stain | Fe Stain | Soap Scum | Lime Scale | Average |
|---|---|---|---|---|---|---|
| DAT 1 | 20 g tablet | 8 | 7 | 5 | 8 | 7 |
| DAT 2 | 30 g tablet | 10 | 8 | 10 | 8 | 9 |
| DAT 3 | 30 g tablet | 9 | 7 | 10 | 8 | 8.5 |
| Sample 3.1 | Oxalic Acid | 9 | 6 | 10 | 7 | 8 |
| Sample 3.2 | Hydroxylamine HCl | 10 | 10 | 9 | 8 | 9.25 |
| Sample 3.3 | Isoascorbic Acid | 10 | 8 | 10 | 8 | 9 |
| Comparativ Sample 3.1 | | 1 | 1 | 4 | 5 | 2.75 |
| Comparativ Sample 3.2 | | 2 | 5 | 9 | 3 | 4.75 |
| Comparativ Sample 3.3 | | 2 | 3 | 1 | 8 | 3.5 |

As the above results demonstrate, the cleaning composition of our invention, as embodied here in DATS 1–3 and Samples 3.1–3.3, significantly outperforms the comparative samples with respect to removal of manganese stains, iron stains, soap scum, and lime scale.

INDUSTRIAL APPLICABILITY

Any composition of this invention, including at least the above-described embodiments and formulations, may be used, either alone or in combination with other components, as a household cleaning product for toilet bowls, and more generally, as a cleaning product for ceramic surfaces, bathroom surfaces, and other hard surfaces. Any composition of this invention, either alone or in combination with other components, may be embodied in a tablet formulation. Powder and granular formulations are also envisioned. The tablet, powder, and granular formulations may be packaged in containers and dispensers designed to promote storage stability of the composition.

While this invention has been described with respect to what is at present considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent formulations and functions.

We claim:

1. A cleaning composition for removing at least kinetically inert metal coordination complex stains from a surface, said composition comprising, in combination:

sodium bisulfate, in an amount between about 10 and about 80 weight percent of the composition;

isoascorbic acid, in an amount between about 0.1 and about 20 weight percent of the composition, for reducing the kinetically inert metal coordination complex stains;

a non-interfering surfactant system; and a complexing system comprising ethylenediaminetetraacetic acid and citric acid, said ethylenediaminetetraacetic acid comprising between about 0.01 and about 10 weight percent of the composition, and said citric acid comprising between about 5 and about 45 weight percent of the composition.

2. A cleaning composition according to claim 1, wherein said sodium bisulfate is present in an amount between about 10 and about 60 weight percent of the composition.

3. A cleaning composition according to claim 1, wherein said sodium bisulfate is present in an amount between about 40 and about 60 weight percent of the composition.

4. A cleaning composition according to claim 1, wherein said isoascorbic acid is present in an amount between about 0.5 and about 10 weight percent of the composition.

5. A cleaning composition according to claim 1, wherein said isoascorbic acid is present in an amount between about 1 and about 5 weight percent of the composition.

6. A cleaning composition according to claim 1, wherein said surfactant system is selected from the group consisting of (a) a mixture sodium lauryl sulfate and sodium dioctyl sulfosuccinate, said sodium lauryl sulfate comprising between about 1 and about 20 weight percent of the composition, and said sodium dioctyl sulfosuccinate comprising between about 1 and about 30 weight percent of the composition; and (b) lauryl amido propyl betaine, in an amount between about 1 and about 40 weight percent of the composition.

7. A cleaning composition according to claim 1, further comprising an effervescing component, in an amount between about 1 and about 50 weight percent of the composition.

* * * * *